United States Patent [19]

Ozawa

[11] Patent Number: 4,893,605

[45] Date of Patent: Jan. 16, 1990

[54] IGNITION DEVICE FOR INTERNAL COMBUSTION ENGINE

[75] Inventor: Masayuki Ozawa, Hyogo, Japan

[73] Assignee: Mitsubishi Denki Kabushiki Kaisha, Tokyo, Japan

[21] Appl. No.: 211,013

[22] Filed: Jun. 24, 1988

[30] Foreign Application Priority Data

Jun. 25, 1987 [JP] Japan ..... 62-158032
Jun. 25, 1987 [JP] Japan ..... 62-158033

[51] Int. Cl.[4] ..... F02P 1/08
[52] U.S. Cl. ..... 123/651; 123/632
[58] Field of Search ..... 123/651, 632, 630, 631, 123/629, 198 D

[56] References Cited

U.S. PATENT DOCUMENTS 3,861,369 1/1975 Canup ..... 123/632
4,342,061 7/1982 Rice et al. ..... 123/630
4,356,809 11/1982 Lo Cascio ..... 123/632
4,368,717 1/1983 Roberts et al. ..... 123/632
4,406,273 9/1983 Yoshinaga et al. ..... 123/651
4,408,592 10/1983 Yoshinaga et al. ..... 123/651
4,531,500 7/1985 Burjou ..... 123/630
4,706,640 11/1987 Andreasson ..... 123/651
4,774,925 10/1988 Iwata ..... 123/632

*Primary Examiner*—Raymond A. Nelli
*Attorney, Agent, or Firm*—Sughrue, Mion, Zinn, Macpeak and Seas

[57] ABSTRACT

An ignition device includes a capacitor 119, a semiconductor switch element 104 and an ignition control circuit 101, by which the cut-off of current supply to the ignition coil 105 is made gradual by supplying charge of the capacitor to the semiconductor switching element when the engine is stopped or the stop switch 117 is operated, the problems caused by undesired abrupt cut-off of the ignition current are eliminated.

3 Claims, 7 Drawing Sheets

IGNITION DEVICE FOR INTERNAL COMBUSTION ENGINE

BACKGROUND OF THE INVENTION

The present invention relates to an ignition device for an internal combustion engine and, particularly, to an ignition device having a stop switch.

FIG. 8 is an example of a circuit diagram of a conventional ignition device which is also disclosed in Japanese Patent Publication No. 24565/1973. In FIG. 8, reference numeral 1 depicts an ignition signal generating circuit which includes a signal generator 11 for generating an alterating ignition timing signal in synchronism with an engine rotation, a diode 12, a resistor 13 and a capacitor 14. An ignition circuit 2 includes resistors 21, 23, 26 and 27, transistors 24, 28 and 29, a diode 25, an ignition coil 3 and a control circuit 4. The control circuit 4 is constituted by diodes 41 and 47, a capacitor 42, resistors 43 to 45 and a transistor 46. Reference numeral 5 depicts a battery.

When there is no ignition signal produced by the ignition signal generating circuit 1, the transistor 24 is made conductive by the resistors 21 and 22, which biases the diode 25 in reverse direction. Therefore, the transistor 28 is turned off and the transistor 29 is turned on to flow a current through the ignition coil 3. Thereafter, when an ignition signal is produced by the signal generator 11 due to an engine rotation, the signal is rectified by the diode 12 and supplied to a base of the transistor 24 to turn it off. Since the diode 25 is biased forwardly by the transistor 25 turned off, a base current is supplied through the resistor 23 to the transistor 28 to turn it on and turn the transistor 29 off. Therefore, a high voltage is induced in a secondary coil side of the ignition coil 3, by which the engine is ignited.

The diode 41 of the control circuit 4 is biased forwardly when the transistor 24 is turned off, so that the capacitor 42 is charged. Upon the charge of the capacitor 42, a base current of the transistor 46 is supplied to turn it on. Since the diode 47 is reverse-biased by the turned-on transistor 46, the control circuit 4 is isolated from the transistor 28, i.e., the ignition circuit 2. When the transistor 24 is turned on under this condition, the diode 41 is reverse-biased and the capacitor 42 discharges through the resistors 43 and 44. By setting the discharge time constant longer than the minimum ignition interval of the engine, it is possible to hold the transistor 46 conductive during the engine rotation and thus the control circuit 4 is isolated from the ignition circuit 2 during the engine rotation.

When the engine is stopped and the transistor 24 is turned on, the transistor 28 is turned off and the transistor 29 is turned on to allow a current to flow through the ignition coil 3. However, since the transistor 46 is turned off when the discharge of the capacitor 42 of the control circuit 4 is completed, a base current is supplied through the resistor 45 and the diode 47 to the transistor 28 to turn it on and turn the transistor 29 off, so that the current of the ignition coil 3 is cut off.

FIG. 9 shows another example of a conventional device and FIG. 10 shows waveforms at various points of the device shown in FIG. 9. In FIGS. 9 and 10, the circuit portion 4 of the example shown in FIG. 8 is substituted by a CPU 50. Other portions of the example in FIG. 9 are substantially the same as those shown in FIG. 8 and depicted by the same reference numerals, respectively.

An ignition control circuit 4, i.e., the CPU, has a reset terminal 50c connected to a power circuit 51 of a power supply 5 and is reset to start an operation from an initial condition when a key switch is operated, an output voltage of the power circuit 51 is lowered or an abnormal condition occurs. FIG. 10 shows this condition. As shown by a waveform (a) in FIG. 10, when the output voltage Vcc of the power supply circuit 51 is lowered below a predetermined level due to a voltage drop at a start of a starter motor, the power supply circuit 51 produces a reset signal whose level in a period $t_1$-$t_2$ as shown by (b) in FIG. 10. In order to avoid a current flow through the ignition coil 3 at a start time of the ignition device, the ignition control circuit 4, i.e., the CPU 50 is designed to provide a H level signal at an output terminal C at $t_2$, as shown by (c) and (e) in FIG. 10. With the H signal at the terminal C, the transistor 29' is turned off and the ignition control operation is started at the time when the current of the ignition coil 3.

Since the potential level at the terminal C is H at the start of the operation of the ignition device, an output impedance of the ignition control circuit 4 is high when the reset signal is supplied thereto (the period $t_1$-$t_2$), the output potential thereof is always L level regardless of the potential at the terminal C, as shown by (c) and (e) in FIG. 10. Since, therefore, the transistor 29' is on during the period $t_1$-$t_2$ and the ignition coil 3 is supplied with current, the ignition coil current is cut off at the start time ($t_1$) of the ignition device so that a spark discharge also occurs, as shown by (d) and (f) in FIG. 10.

As mentioned above, in either of the conventional devices, a persistent current supply to the ignition coil 3 when the engine is not operating is prevented by the control circuit 4. In such case, however, since the current supply to the ignition coil 3 is performed in the same manner as in the period of ignition, a high voltage is induced in the secondary coil of the ignition coil 3 when the current supply is stopped and thus spark occurs. Therefore, depending upon a condition of the engine at a time when it is stopped, there is a possibility of damaging the engine due to the ignition of fuel which is left unburnt in a cylinder of the warmed up engine when the device is reset, even at an unsuitable crank position.

In order to prevent such phenomenon from occuring, an internal combustion engine ignition device having an emergency stop switch has been developed. In such device, a current supply to an ignition coil is usually stopped by an actuation of the stop switch. However, since such actuation causes a high voltage in a secondary side of the ignition coil to be induced as in the same manner mentioned above, the problem is still left as it is.

SUMMARY OF THE INVENTION

An object of the present invention is to provide an ignition device for an internal combustion engine, in which a current supply to an ignition coil when the engine is stopped is prevented so that an ignition can not occur when a stop switch is operated.

According to the present invention, the above object can be achieved by an ignition device comprising a capacitor for supplying charge to a control gate of a semiconductor switch element for on-off controlling an ignition coil current and a switch circuit for charging the capacitor with a current from a power source and cutting off a current supply from the power source to the capacitor.

When the engine is stopped while the engine is warmed up with an ignition current being supplied continuously or the stop switch is operated, the switch circuit cuts the charging current to the capacitor which discharges its charge to the control gate of the semiconductor switch element, so that an amount of current flowing through the ignition coil is reduced correspondingly to a reduction rate of the discharge current to the control gate to thereby gradually cut off the ignition coil current. In a case where the stop switch chatters, the semiconductor switch gradually reduces the ignition coil current according to a discharge time constant of the capacitor, preventing undesired ignition from occuring.

According to another aspect of the invention, the power source includes a circuit portion which supplies a reset signal to the ignition circuit for a time longer than a discharge time of the capacitor.

The capacitor continues to discharge to the control gate of the semiconductor switch element during a time in which the reset signal is being sent from the power source circuit portion. Therefore, the ignition coil current is reduced gradually to zero, preventing the erroneous ignition from occuring.

DETAILED DESCRIPTION OF THE PREFERRED EMBODIMENTS

Figure 1:
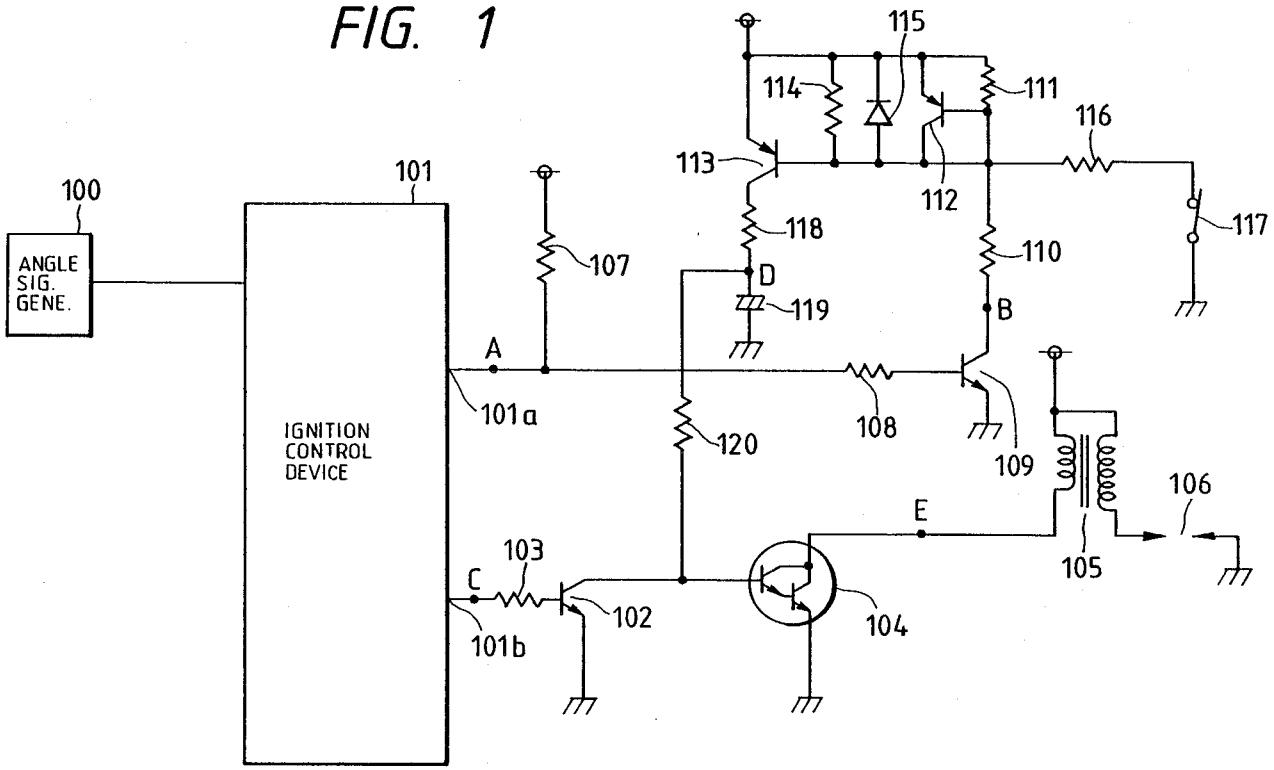
FIG. 1 is a circuit diagram of an embodiment of an ignition device according to the present invention.

In FIG. 1 which shows an embodiment of the present invention, an ignition device includes an angle signal generator 100 and an ignition control device 101 responsive to an output of the angle signal generator 100 to calculate an ignition timing and to detect a stop of an engine, which includes a stop signal output terminal 101*a* and an ignition timing control output terminal 101*b*. The ignition device further includes an NPN transistor 102 having a base connected through a resistor 103 to the timing control signal terminal 101*b*, a collector connected to a base of a power transistor 104 and an emitter grounded. A collector of the power transistor 104 is connected to a primary coil of an ignition coil 105 and emitter grounded. An ignition plug 106 is connected to a secondary coil of the ignition coil 105 as usual.

The stop signal output terminal 101*a* of the ignition control device 101 is connected through a resistor 107 to a power source and through a resistor 108 to a base of an NPN transistor 109 whose collector is connected through resistors 110 and 111 to the power source and emitter grounded. A PNP transistor 112 has a base connected to a junction between the resistors 110 and 111, an emitter to the power source and a collector to a base of a PNP transistor 113. A resistor 114 and a diode 115 are connected in parallel and inserted between the emitter and the base of the transistor 113, the base being grounded through a resistor 116 and a normally closed stop switch 117. The emitter of the transistor 113 is connected to the power source and a collector thereof is connected through a resistor 118 to one pole of a capacitor 119 having the other pole being grounded. The one pole of the capacitor 119 is connected through a resistor 120 to a base of the power transistor 104. A switch circuit for on-off controlling a current supply to the capacitor 119 is constituted with the elements depicted by the reference numerals 109 to 115.

An operation of the ignition device shown in FIG. 1 will be described with reference to FIG. 2 which shows waveforms a to e at points A to E of the device when it is operating normally.

Figure 2:
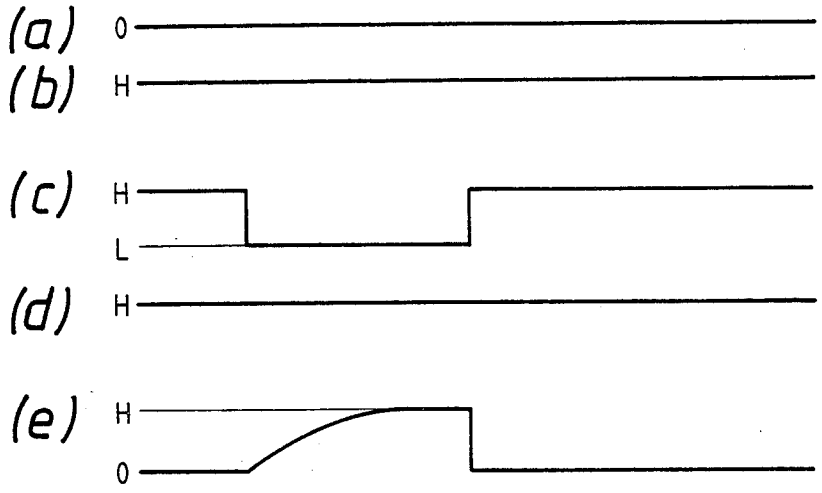
FIG. 2 shows waveforms at various points of the circuit in FIG. 1 during a normal operation thereof.

The ignition control device 101 responds to an angle signal from the angle signal generator 100 to calculate an ignition timing signal which is sent from the ignition timing control signal output terminal 101*b* as an ignition timing control signal (FIG. 2 (*c*)). Since the engine is rotating, there is no stop signal provided on the stop signal output terminal 101*a* of the ignition control device 101 (FIG. 2 (*a*)) and thus the transistor 109 is off providing a potential H (FIG. 2 (*b*)) at point B. As a result, the transistor 112 is off and, since the stop switch 117 is closed, the transistor 113 is turned on to supply a current from the power source to the capacitor 119 and to the base of the power transistor 104 to thereby maintain a potential at point D in H level (FIG. 2 (D)).

When the ignition timing control signal becomes L level, the transistor 102 is turned off and the potential at point D is applied to the power transistor 104 to turn it on to thereby allow a current shown by the waveform (e) in FIG. 2 to flow to the primary coil of the ignition coil 105. Then, when the potential at point C becomes H level, the transistor 102 is turned on and so the current from point D is branched. Therefore the power transistor 104 is turned off and the current of the ignition coil 105 is cut off, causing a high voltage to be induced in the secondary coil thereof, which causes the ignition plug 106 to spark-discharge to thereby ignite the engine.

Figure 3:
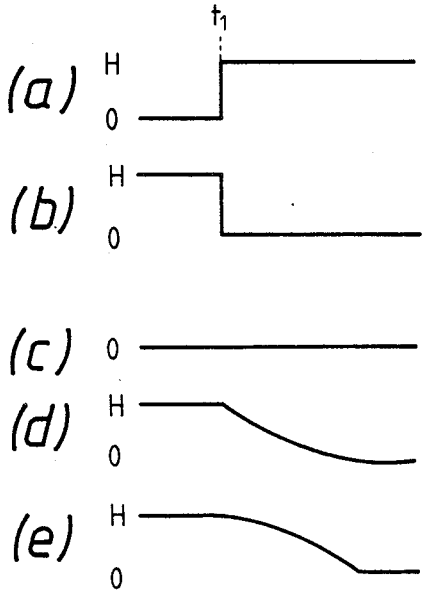
FIG. 3 shows waveforms at these points of the present circuit when the engine is stopped.

In a case where the engine is stopped while the current supply to the ignition coil 105 continues, operational waveforms at these points become as shown by (a) to (e) in FIG. 3, respectively. That is, at a time $t_1$, a stop signal is produced at the stop signal output terminal 101*a* of the ignition control device 101 as shown by waveform (a) in FIG. 3, so that the transistor 109 is turned on and a potential at point B becomes L level as shown by waveform (b) in FIG. 3. Thus, the transistor 112 is turned on to short-circuit the emitter-base circuit of the transistor 113 to thereby cut a voltage supply from the power source to the capacitor 119. As a result, the potential at point D reduces generally at a rate determined by a CR time constant of the capacitor 119 and the resistor 120 from H level to L level as shown by waveform (d) in FIG. 3. Since the potential at point C is L level, the transistor 102 is off, so that the base current of the power transistor 104 reduces gradually and its collector current, i.e., the current of the ignition coil 105, reduces generally as shown by waveform (e) in FIG. 3. Therefore, no spark discharge is produced at the ignition plug 106. It should be noted that the stop signal of the ignition control device can be provided when the engine rotation is not more than 60 to 70 rpm.

Figure 4:
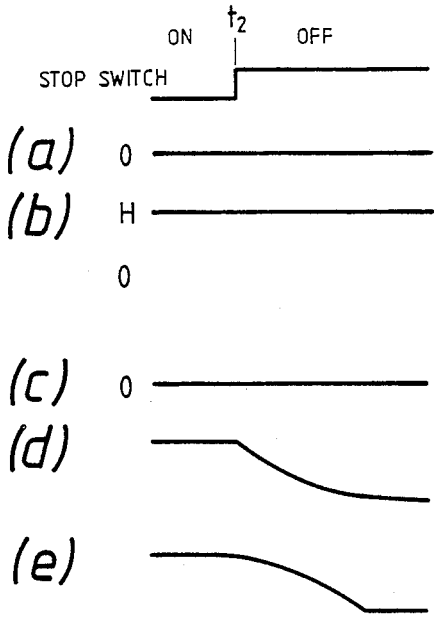
FIG. 4 shows waveforms at these points when a stop switch is operated.

FIG. 4 shows waveforms at these circuit points when the stop switch 117 is operated at a time $t_{12}$. When the switch 117 is closed by the operation, the transistor 113 is turned off and the potential at point D reduces gradually from H level to L level as in the case of the engine stop. Since the operation of the stop switch 117 is usually performed when the engine is rotating, the potential at point A becomes L level as shown by waveform (a) in FIG. 4 and that at point B becomes H level as shown by waveform (b) in FIG. 4. Further, since the operation of the stop switch 117 when the current supply to the ignition coil 105 is stopped is ineffective, it is assumed in the following description that the current supply to the ignition coil 105 is still continued and the potential at point C is L level as shown by waveform (c) in FIG. 4. With the gradual reduction of the potential at point D from H level to L level, the current of the ignition coil 105 reduces gradually as in the case where the engine is stopped as shown by waveform (e) in FIG. 4, so that spark discharge at the ignition plug 106 is prevented.

Figure 5:
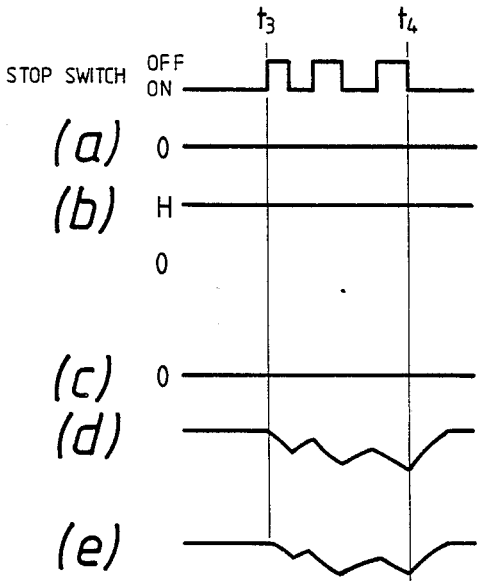
FIG. 5 shows waveforms at these points when the stop switch chatters.

In the case of chattering of the stop switch 117, when such chattering occurs in a time from $t_3$ to $t_4$ as shown in FIG. 5 while the potential levels at points A, B and C shown by waveforms (a), (b) and (c) in FIG. 5 are the same as those shown in FIG. 4, the potential at point D changes as shown by waveform (d) in FIG. 5. That is, the potential at point D reduces according to the discharge time constant of the capacitor 119 and the resistor 120 even if the stop switch 117 is opened and so the current of the ignition coil 105 changes correspondingly thereto as shown by waveform (e) in FIG. 5. As a result, the change of the current of the ignition coil 105 is mild enough to prevent spark discharge at the ignition plug 106.

Figure 6:
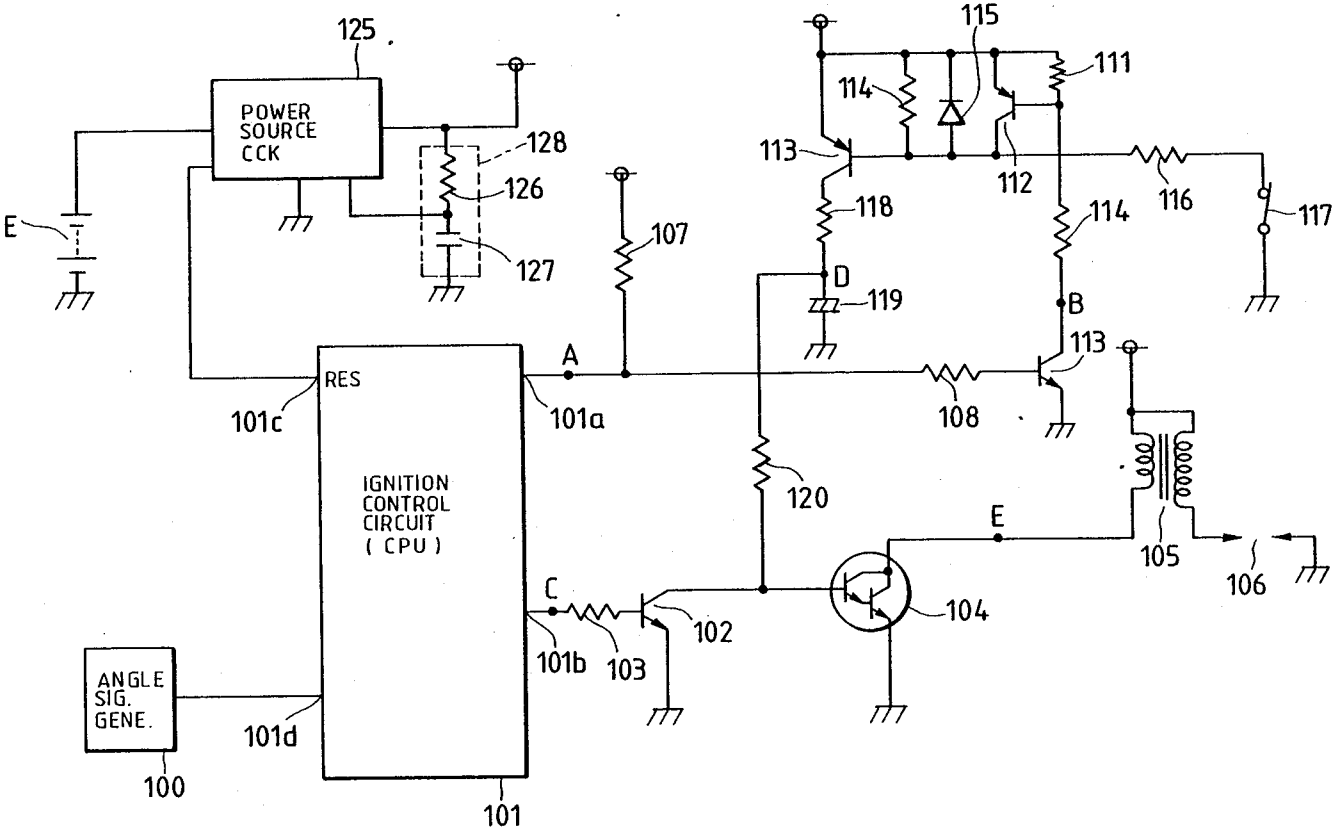
FIG. 6 is a circuit diagram of another embodiment of the present invention.

FIG. 6 shows another embodiment of the present invention which differs from the embodiment shown in FIG. 1 in that a power supply circuit portion 125 and a CR circuit, or a timer circuit, 128 composed of a resistor 126 and a capacitor 127 for changing a width of a reset signal are added and the ignition control circuit 101 has a reset terminal 101*c*.

A normal operation of this embodiment is the same as that of the first embodiment and is shown by waveforms (a), (b), (c), (d) and (e) at points A, B, C, D, and E in FIG. 2.

Figure 7:
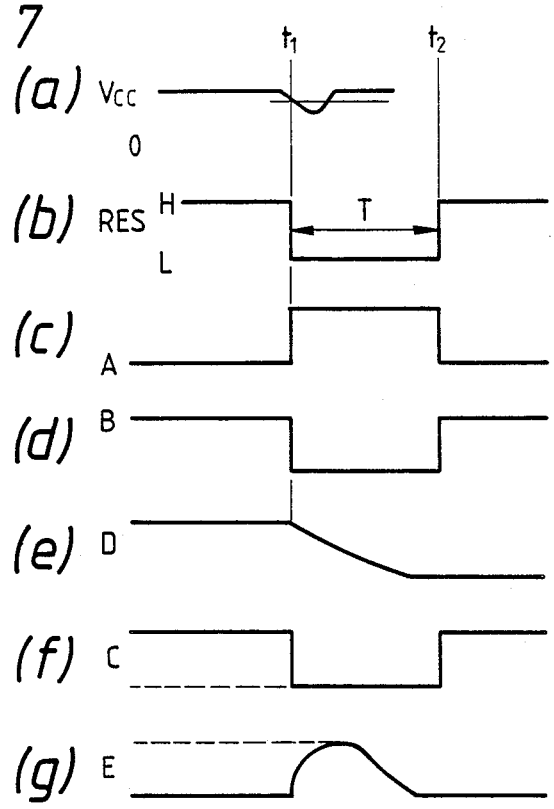
FIG. 7 shows waveforms at these points when the circuit is reset.
Figure 8:
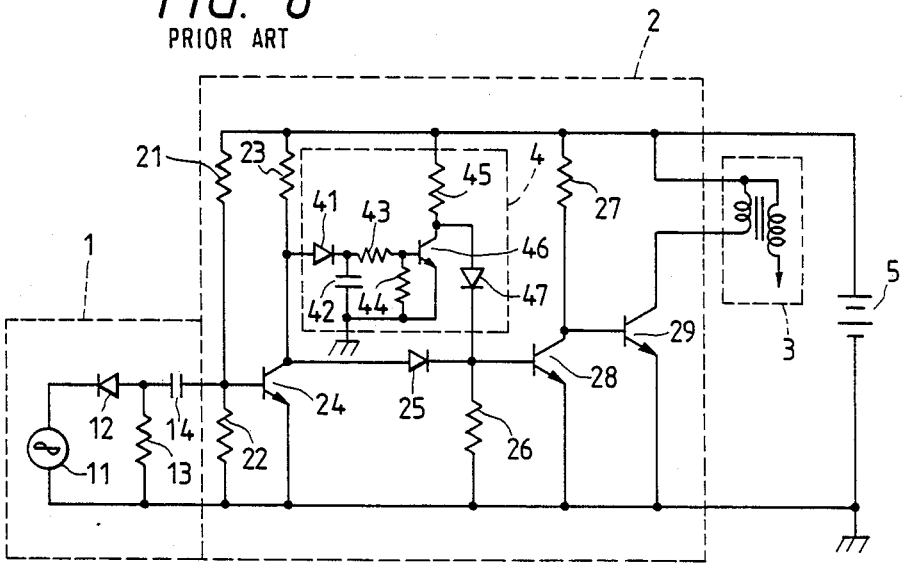
FIG. 8 PRIOR ART
FIG. 8 is a circuit diagram of a conventional ignition device.
Figure 9:
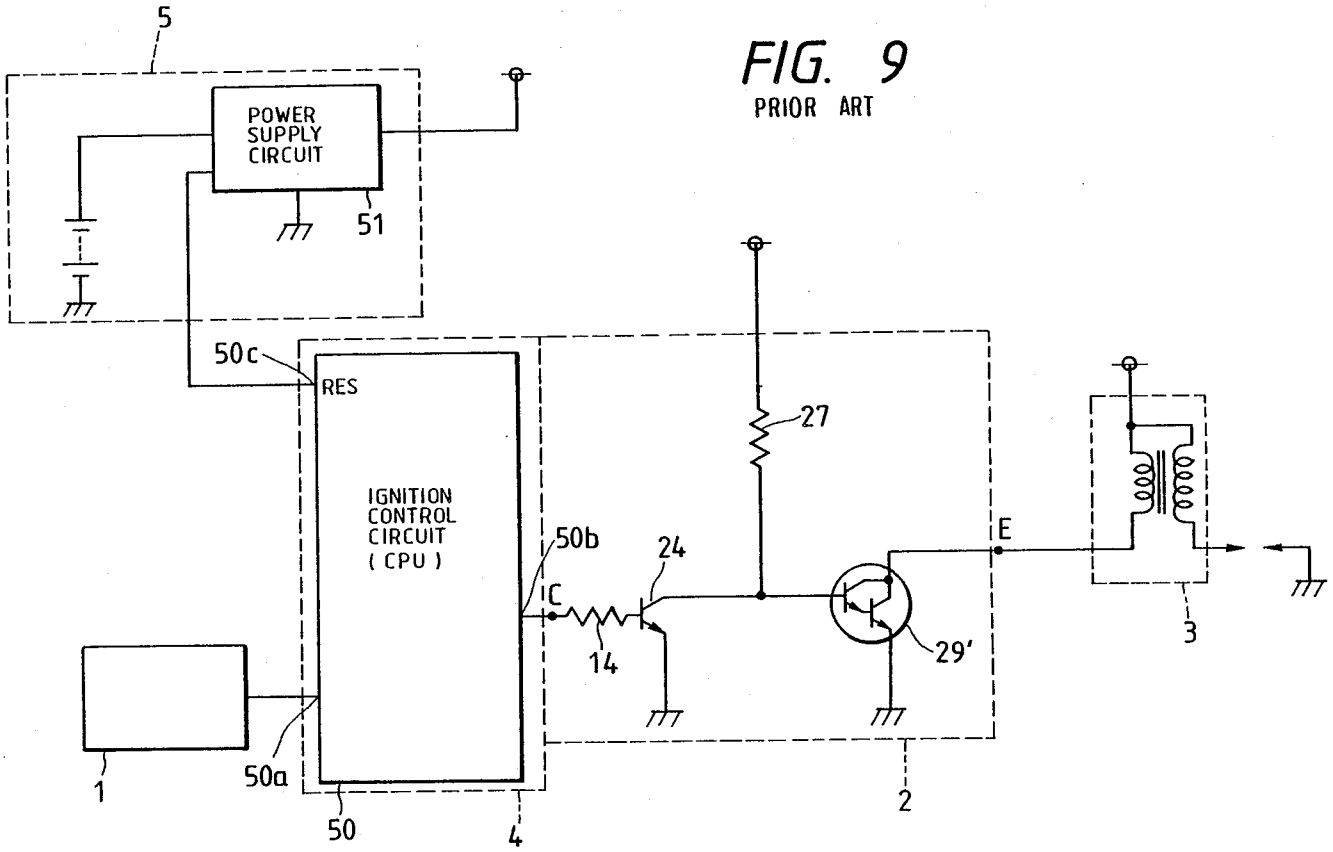
FIG. 9 PRIOR ART
FIG. 9 is a circuit diagram of another conventional device.
Figure 10:
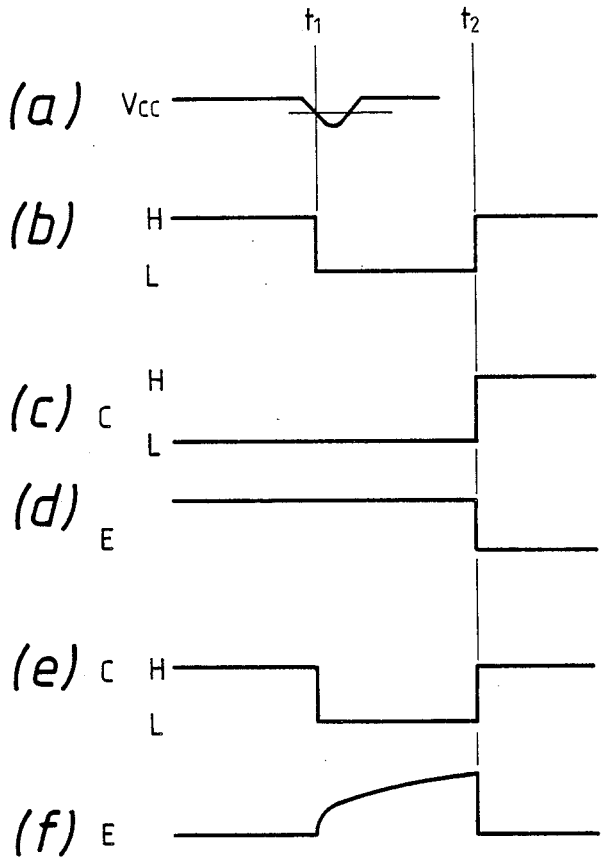
FIG. 10 shows waveforms at various points of the circuit in FIG. 9.

When an output voltage Vc of the power source circuit 125 is lowered below a predetermined level due to such as engine starting as shown in waveform (a) in FIG. 7, the circuit 125 provides the reset signal as shown by waveform (b) in FIG. 7. With the reset signal, the levels at the stop signal output terminal 101*a* of the ignition control device 101 and the ignition timing control signal output terminal 101*b* thereof become H and L levels as shown by waveforms (c) and (f) in FIG. 7, respectively. Therefore, the potential at point B becomes L level as shown by waveform (d) in FIG. 7. Consequently, transistor 113 is turned off to discharge capacitor 119. Therefore, the potential at point D reduces gradually with a rate determined by a time constant of the capacitor 113 and a resistor 120 as shown by waveform (e) in FIG. 7, so that a current of an ignition coil 105 reduces gradually to zero with the reduction of the potential at the point D after once increased at $t_1$, as shown by waveform (g) in FIG. 7. In a case where the potential at the ignition timing control output terminal 101*b* prior to resetting is L as shown by a dotted line portion of a waveform (f) in FIG. 7, the current of the ignition coil 105 reduces gradually from the time $t_1$ when reset since the current is flowing through the ignition coil 105 as shown by a dotted line portion of a waveform (g). In such operation, since the width T of the reset signal is set as longer than the discharge time of the capacitor 119, the potential at point D is always L level even when the potential level at the point C becomes H after the ignition control circuit 101 starts to operate at the time $t_1$. Therefore, there is no abrupt cut off of the current of the ignition coil 105.

When the engine is stopped while the current supply to the ignition coil 105 continues, the ignition control circuit 101 provides a stop signal. Therefore, the potential at the point A becomes H and the potential at the point D reduces gradually as in the reset time $t_1$-$t_2$ since the potential level at the point C is L, so that the current supply to the ignition coil 105 is prevented and so the erroneous ignition at the current cut off is also prevented.

As described hereinbefore, according to the present invention in which the cut-off of current supply to the ignition coil is made gradual by supplying charge of the capacitor to the semiconductor switching element when the engine is stopped or the stop switch is operated, the problems caused by undesired abrupt cut-off of the ignition current are eliminated.

What is claimed is:

1. An ignition device for an internal combustion engine, comprising: an angle signal generator for producing a timing signal in synchronism with an engine rotation, an ignition control device responsive to an output signal of said angle signal generator for performing a predetermined ignition timing calculation to produce an ignition timing control signal, and for detecting an engine stop condition to produce a stop signal, a semiconductor switch element having a control gate supplied with said ignition timing control signal for supplying current to an ignition coil upon receipt of said ignition timing control signal to on-off control the current supply to said ignition coil, a capacitor for supplying charge to said control gate of said semiconductor switch element, a switch circuit for maintaining said capacitor fully charged by continuously supplying a current thereto during normal running of the engine, and means for cutting said current to said capacitor off when either said ignition control device produces said stop signal or a stop switch is operated such that said capacitor gradually discharges to a level at which said switch element is rendered non-conductive, to thereby preclude dieseling or the like.

2. The ignition device as claimed in claim 1, wherein said ignition control device comprises a microcomputer.

3. The ignition device as claimed in claim 1 or 2, further comprising a power source circuit (125) for supplying voltage to said ignition device and for producing a reset signal for initializing said ignition control circuit, said reset signal having a width longer than a discharge time of said capacitor.

* * * * *